US008044898B2

(12) United States Patent
Sakai et al.

(10) Patent No.: US 8,044,898 B2
(45) Date of Patent: Oct. 25, 2011

(54) LED DISPLAY APPARATUS HAVING A COLUMN AND ROW CONTROLLER

(75) Inventors: Hiroyuki Sakai, Tokyo (JP); Takehiro Koyama, Tokyo (JP); Hideki Muramatsu, Tokyo (JP); Toshiaki Kobayashi, Tokyo (JP)

(73) Assignee: Nagano Keiki Co., Ltd., Tokyo (JP)

( * ) Notice: Subject to any disclaimer, the term of this patent is extended or adjusted under 35 U.S.C. 154(b) by 990 days.

(21) Appl. No.: 11/979,042

(22) Filed: Oct. 30, 2007

(65) Prior Publication Data

US 2008/0252574 A1 Oct. 16, 2008

(30) Foreign Application Priority Data

Apr. 16, 2007 (JP) ..... 2007-106977

(51) Int. Cl.
*G09G 3/32* (2006.01)

(52) U.S. Cl. ..... 345/82; 345/34

(58) Field of Classification Search ..... 345/82, 345/34

See application file for complete search history.

(56) References Cited

U.S. PATENT DOCUMENTS

| | | | | |
|---|---|---|---|---|
| 3,796,951 | A * | 3/1974 | Joseph | 324/122 |
| 5,051,729 | A * | 9/1991 | Gray | 340/626 |
| 5,471,267 | A * | 11/1995 | Goto et al. | 396/317 |
| 5,629,642 | A * | 5/1997 | Yoshimura | 327/142 |
| 6,894,610 | B2 * | 5/2005 | Schubert et al. | 340/531 |
| 6,985,124 | B1 | 1/2006 | Nogawa | |
| 7,557,802 | B2 * | 7/2009 | Hayafuji et al. | 345/212 |
| 2004/0085086 | A1 * | 5/2004 | LeChevalier | 324/770 |
| 2004/0233148 | A1 * | 11/2004 | Tanghe et al. | 345/83 |
| 2005/0231459 | A1 * | 10/2005 | Furukawa | 345/102 |
| 2006/0232219 | A1 * | 10/2006 | Xu | 315/209 R |
| 2007/0147415 | A1 * | 6/2007 | Marusca et al. | 370/465 |
| 2007/0188425 | A1 * | 8/2007 | Saccomanno | 345/82 |
| 2007/0247415 | A1 * | 10/2007 | Yasunaga | 345/102 |
| 2007/0257623 | A1 * | 11/2007 | Johnson et al. | 315/193 |
| 2007/0279323 | A1 * | 12/2007 | Park et al. | 345/55 |
| 2008/0181794 | A1 * | 7/2008 | Steinfels et al. | 417/234 |

FOREIGN PATENT DOCUMENTS

JP 5-129665 A 5/1993

(Continued)

*Primary Examiner* — Chanh Nguyen
*Assistant Examiner* — Kwang-Su Yang
(74) *Attorney, Agent, or Firm* — Birch, Stewart, Kolasch & Birch, LLP

(57) ABSTRACT

An LED display apparatus 1 in which at least multiple LEDs are serially-connected to a power circuit part having a constant current power source, each one of the LEDs has a switching element parallel-connected thereto, and a control circuit part is used to selectively turn on/off the switching elements to control the LEDs for a specific display, characterized by the fact that the apparatus comprises a display matrix circuit part 9 constituted by parallel-connecting to the power circuit part 8 multiple LED circuits 7*a*, 7*b*, 7*c* . . . consisting of multiple LEDs 2 . . . and a single first switching element 3*a*, 3*b*, 3*c* . . . serially-connected and second switching element 4 . . . each parallel-connected to one of the LEDs 2 . . . , and a control circuit part 10 turning on the first switching elements 3*a* . . . for a given time period (Ts) in sequence and turning on/off a row La, Lb, Lc . . . of multiple second switching elements 4 . . . extending across the LED circuits 7*a* . . . of the display matrix circuit part 9 in correspondence with the first switch 3*a* . . . being turned on.

12 Claims, 6 Drawing Sheets

FOREIGN PATENT DOCUMENTS

| | | | |
|---|---|---|---|
| JP | 5-131681 | A | 5/1993 |
| JP | 8-194448 | A | 7/1996 |
| JP | 2001-109433 | A | 4/2001 |
| JP | 9-8121 | A | 3/2007 |
| JP | 981211 | A | 3/2007 |

* cited by examiner

LED DISPLAY APPARATUS HAVING A COLUMN AND ROW CONTROLLER

BACKGROUND OF THE INVENTION

1. Field of the Invention

The present invention relates to an LED display apparatus in which switching elements are parallel-connected to multiple serially-connected LEDs, respectively, and turned on/off to display figures and the like.

2. Description of the Related Art

LED display apparatuses using multiple LEDs to display figures and the like are known. The normally-on LED display apparatus must satisfy general requirements such as small size, low price, and high quality display and other performances, particularly low power consumption and operation with a low voltage power source.

Such LED display apparatuses are known from the Japanese Patent Publication Nos. 9 (1997)-81211 (Patent Document 1), 5 (1993)-129665 (Patent Document 2), 5 (1993)-131681 (Patent Document 3), 8 (1996)-194448 (Patent Document 4), and 2001-109433 (Patent Document 5). Patent Document 1 discloses a display circuit having a constant current power source, multiple serially-connected light emitting elements serially-connected to the constant current power source, and bypass circuits provided one each to the light emitting elements and parallel-connected to the corresponding one of them wherein the bypass circuit shorts between the ends of the corresponding light emitting element at sufficiently smaller resistance than that of the corresponding light emitting element in response to supplied control signals. Patent Document 2 discloses an LED drive circuit comprising a set of light emitting elements serially-connected in the forward direction, a constant current power source supplying the set of light emitting elements with a constant current, a set of switching elements each parallel-connected to one of the set of light emitting elements to turn on/off the corresponding light emitting element based on external control signals. Patent Document 3 discloses an LED array apparatus comprising an LED array consisting of a number of LEDs juxtaposed and a circuit controlling the conduction of the individual LEDs wherein the LED array apparatus is provided with an LED array consisting of serially-connected LEDs, switching elements each parallel-connected to one of the LEDs, and a constant current unit powering the LED array. Patent Document 4 discloses a display apparatus comprising a light source constituted by a serial element consisting of multiple serially-connected LEDs wherein a constant current element is serially-connected to the serial element. Patent Document 5 discloses a dot matrix display apparatus in which multiple scanning electrodes and multiple signal electrodes intersect in a matrix form and a display element is driven by the voltage between the scanning electrode and the signal electrode at each intersection of the matrix wherein a rectifying element is electrically connected in a specific electrode direction between a scanning electrode and a reference voltage terminal supplying a given reference potential and the charge on the scanning electrode is discharged to the reference voltage terminal via the rectifying element.

However, the above described prior art LED display apparatuses have the following problems.

First, a necessary number of LEDs are serially-connected in Patent Documents 1, 2 and 3. Therefore, in Patent Documents 1, 2 and 3, a higher drive voltage is required in correspondence with the number of LEDs to be used, leading to a larger power source and increased cost. If a higher drive voltage is not available, the number of LEDs to be used is limited or their luminance may be lowered. When the LEDs are parallel-connected, the luminance may not be uniform and the power consumption is increased.

A necessary number of LEDs are used in a combination of serial-connection and parallel-connection, in other words they are connected in a matrix array in Patent Documents 4 and 5. When a matrix connection is used, the drawbacks with the serial-connection and parallel-connection can be eliminated to a certain extent. However, the parallel circuits (row) or serial circuits (column) are controlled as a group. Therefore, the individual LEDs are not controlled, disadvantageously limiting display applications.

SUMMARY OF THE INVENTION

A purpose of the present invention is to provide an LED display apparatus that allows for a down-sized power circuit part and reduced cost, eliminates inconvenient limitation on the number of LEDs to be used and lowered luminance, and realizes uniform luminance and low power consumption, thereby resolving the prior art contradictive problems in particular.

Another purpose of the present invention is to provide an LED display apparatus that eliminates inconvenient limitation on display applications, increases universality, and realizing more versatile displays.

In order to achieve the above purposes, the present invention provides an LED display apparatus in which at least multiple LEDs are serially-connected to a power circuit part having a constant current power source, each one of the LEDs has a switching element parallel-connected thereto, and a control circuit part is used to selectively turn on/off the switching elements to control the LEDs for a specific display, characterized by the fact that the apparatus comprises a display matrix circuit part constituted by parallel-connecting to the power circuit part multiple LED circuits each consisting of multiple LEDs and a single first switching element serially-connected and second switching elements each parallel-connected to one of the LEDs, and a control circuit part turning on the first switching elements for a given time period in sequence and turning on/off a row of multiple second switching elements extending across the LED circuits of the display matrix circuit part in correspondence with the first switch element being turned on.

DETAILED DESCRIPTION OF THE PREFERRED EMBODIMENT

A preferred embodiment of the present invention is described in detail hereafter with reference to the drawings. The attached drawings are intended to facilitate the understanding of the present invention, not to restrict the present invention. Known matters are not described in detail to prevent the present invention from becoming unclear.

A pressure gauge M for which an LED display apparatus 1 according to this embodiment is preferably used is outlined with reference to FIGS. 3 to 6.

Figure 3:
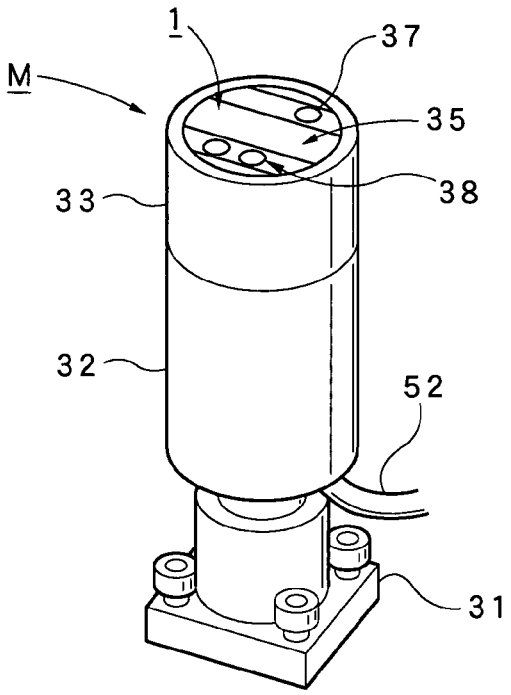
FIG. 3 is a perspective view of the exterior of a pressure gauge having the LED display apparatus.
Figure 4:
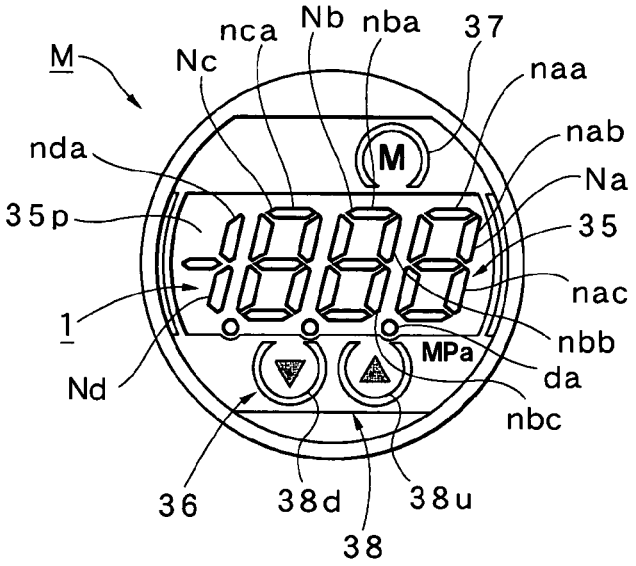
FIG. 4 is a plane view of the exterior of the LED display apparatus.

FIGS. 3 and 4 show the exterior of a pressure gauge M. The pressure gauge M has a mounting part 31 for mounting to a detection object A shown in FIG. 6, a detection body 32 integrated with the mounting part 31, and a processing body 33 attached to the detection body 32.

The detection body 32 has a cylindrical exterior and contains a pressure sensor 43 (FIG. 5) consisting of a strain gauge formed on a metal diaphragm by PCVD process. On the other hand, the processing body 33 having a cylindrical exterior is attached to the top surface of the detection body 32. A display 35 and an operation part 36 as shown in FIG. 4 are provided on the top surface of the processing body 33. The display 35 has an LED display panel 35*p*. The display 35 is constituted by the LED display apparatus 1 according to this embodiment. The operation part 36 has a mode key 37 for switching the modes and an up/down key 38 consisting of an up key 38*u*, and a down key 38*d*. The processing body 33 can be rotated about the axis of the detection body 32 to change the orientation (angle) of the display 35.

Figure 5:
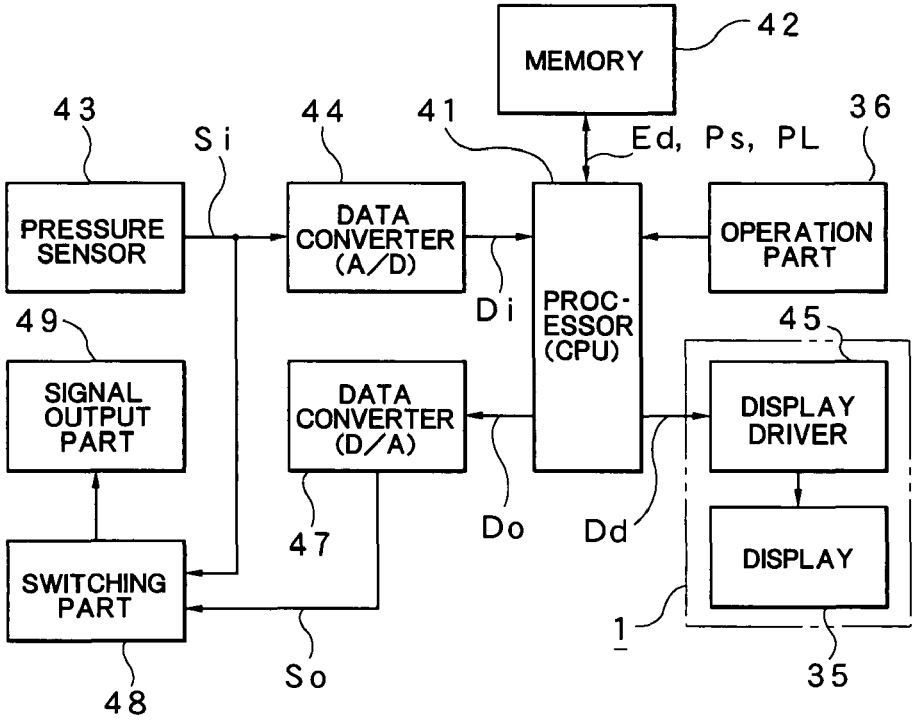
FIG. 5 is a block diagram of the electric system installed in the pressure gauge.

FIG. 5 is a block diagram of the electric system installed in the pressure gauge M. A processor 41 executing various calculations comprises a microcomputer including a CPU. The processor 41 has a memory 42 connected thereto for storing various data. A pressure sensor 43 detects a pressure (applied pressure) P of the detection object A and outputs a detected signal Si corresponding to the applied pressure P. The detected signal Si is supplied to the processor 41 via an input data converter 44. The input data converter 44 amplifies the detected signal Si, which is an analog signal, to a specific level using an amplifying circuit and converts it to an input signal (digital signal) Di for example at 10 [ms] intervals using an analog-digital (A/D) conversion function.

On the other hand, the LED display apparatus 1 according this embodiment is connected to the processor 41. The LED display apparatus 1 consists of a display driver 45 connected to the processor 41 and a display 35 connected to the display driver 45. The input signal Di is converted to a pressure value corresponding to the applied pressure P in the processor 41. Then, a processed signal Dd corresponding to the pressure value is supplied to the display driver 45 and the pressure value is displayed on the display 35. The operation part 36 including the mode key 37 and up/down key 38 is also connected to the processor 41.

Furthermore, an output data converter 47 is connected to the processor 41. The processor 41 supplies an output signal (digital signal) Do corresponding to the pressure value to the output data converter 47 at 10 [ms] intervals. The output data converter 47 converts the output signal Do to an analog output signal So using a digital-analog (D/A) conversion function. The output signal So is supplied to a signal output part 49 via an output switching part 48. The output switching part 48 also receives the detected signal Si from the pressure sensor 43. In this way, the output signal So or the detected signal Si is selectively supplied to the signal output part 49 as the output switching part 48 is switched. The signal output part 49 converts these signals to an output signal of, for example, DC 4 to 20 [mA], DC 1 to 5 [V] and externally outputs it via a connection cable 52 described later. The signal output part 49 advantageously allows various signals to be externally output. The output system can be realized by a switching means such as a transistor or relay that is turned on/off by the processor 41 to externally output digital signals using an open collector or contact output.

Figure 6:
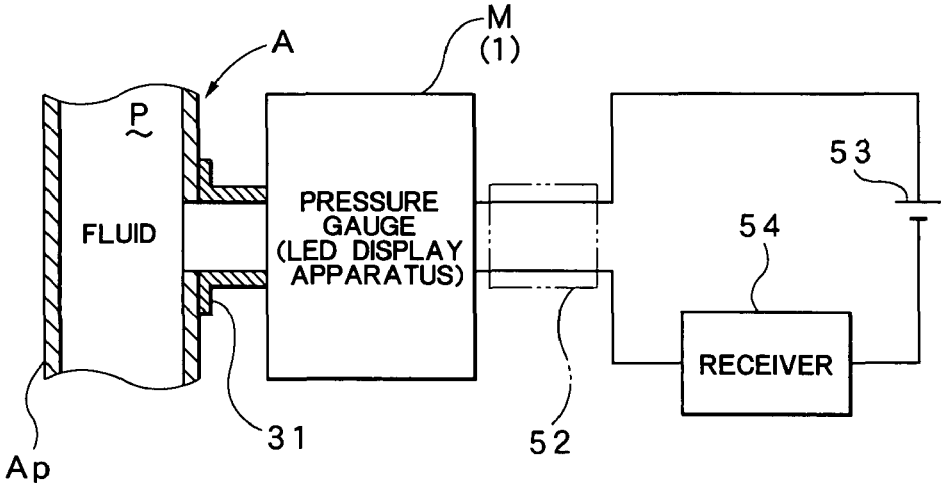
FIG. 6 is a diagram of connection lines showing an application of the pressure gauge.

FIG. 6 shows an application of the pressure gauge M. The pressure gauge M is mounted, for example, onto a pipe Ap through which fluid or a detection object A such as gas and oil flows via the mounting part 31. The pressure gauge M is connected to a series circuit of a DC power source (direct current power source) 53 and a receiver 54 in a two-wire transfer system via the connection cable 52.

Figure 1:
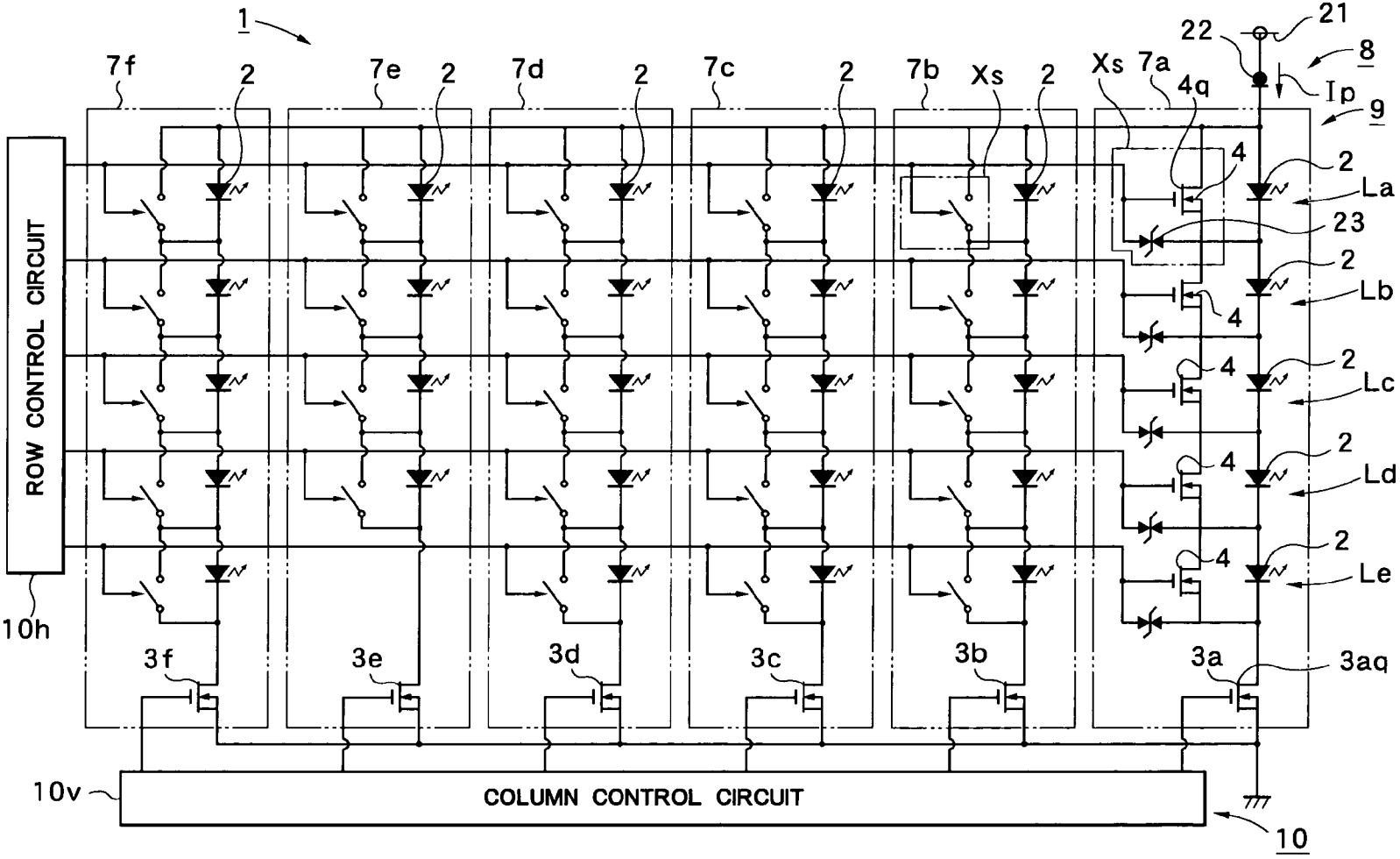
FIG. 1 is an electric circuit diagram showing the basic structure of the core part of an LED display apparatus according to the best embodiment of the present invention.
Figure 2:
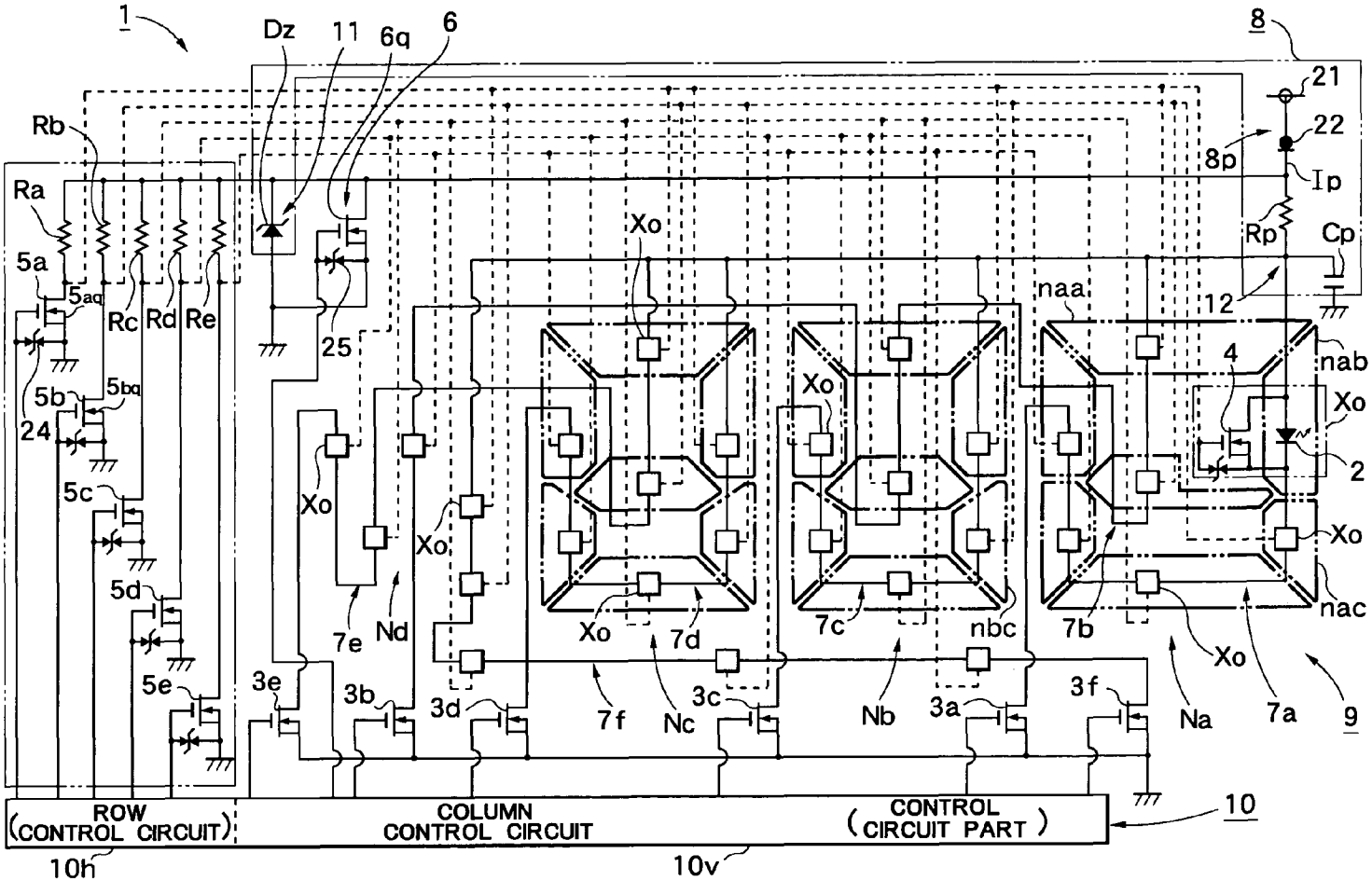
FIG. 2 is an electric circuit diagram more specifically showing the basic structure of the LED display apparatus.

The structure of the LED display apparatus 1 according to this embodiment is described hereafter with reference to FIGS. 1 and 2.

The LED display apparatus 1 has the display 35 and the display driver 45 connected to the display 35. As shown in FIG. 4, the display 35 uses an LED display panel 35*p* to display at least 3.5 seven-segment figures Na, Nb, Nc, and Nd. The segments naa, nab, nac, . . . , nba, nbb, nbc . . . , nca . . . , nda, . . . of the figures Na, Nb, Nc, . . . and dots da . . . are formed by LEDs (light emitting diodes) 2 . . . The components of the LED display apparatus 1 except for LED 2 . . . constitute the display driver 45.

On the other hand, the display driver 45 has main components such as a power circuit part 8, a display matrix circuit part 9, and a control circuit part 10 as shown in FIGS. 1 and 2. FIG. 1 shows their basic structure and FIG. 2 shows more specific circuits than FIG. 1.

The power circuit part 8 comprises a constant current power source 8*p* as shown in FIG. 2. The constant current power source 8*p* consists of a constant current diode (constant current element) 22 connected to a direct current hot line 21. The power circuit part 8 further comprises an integration circuit 12 connected to the constant current power source 8*p*. The integration circuit 12 consists of a resistor Rp connected between the cathode of the constant current diode 22 and the display matrix circuit part 9 described later and a capacitor Cp connected between the current output end of the resistor Rp and the ground. The power circuit part 8 comprises a constant voltage circuit 11 using a zener diode Dz connected between the cathode of the constant current diode 22 and the ground.

The display matrix part 9 comprises six parallel-connected LED circuits 7*a*, 7*b*, 7*c*, and 7*f* as shown in FIG. 1. Then, the LEDs 2 . . . form a matrix array. The display matrix circuit part 9 is connected to the power circuit part 8 at the hot line connection point and to the ground at the ground connection point. The LED circuit 7*a* is constituted by serially-connecting five LEDs 2 . . . and a single first switching element 3*a* and parallel-connecting a second switching element 4 . . . to each one of the LEDs 2 . . . . In this case, the first switching element 3*a* is an n-type FET 3*aq* and the second switching elements 4 . . . are n-type FETs 4*q* . . . . In the figure, the number 23 presents a bidirectional zener diode connected between the gate and the sources of each FET 4*q* . . . . The LED circuits 7*b*, 7*c*, 7*d*, and 7*f* other than the LED circuit 7*e* have the same structure as the LED circuit 7*a*. The LED circuit 7*e* has the same structure as the LED circuit 7*a* except that four LEDs 2 . . . are provided. In FIG. 1, the numbers 3*b*, 3*c*, 3*d*, . . . , and 3*f* present the first switching elements and the second switching elements 4 . . . are omitted in the LED circuits 7*b*, 7*c*, 7*d*, . . . , and 7*f*. The circuits Xs enclosed by dash-dot-dot lines in the LED circuits 7*b* . . . other than the LED circuit 7*a* are the same as Xs enclosed by dash-dot-dot lines in the LED circuit 7*a*.

The LEDs 2 . . . in one or more LED circuits 7*a* . . . extend over multiple digits (figures Na, Nb, . . . ) as shown in FIG. 2. For example, the LED circuit 7*b* has two LEDs 2 . . . provided for the least significant digit (the figure Na), two LEDs 2 . . . provided for the next higher digit (the figure Nb), and one LED 2 provided for the most significant digit (the figure Nc). In FIG. 2, the circuit Xo enclosed by dash-dot-dot lines in the LED circuit 7*a* and the open blocks Xo are the same. This arrangement of the LEDs 2 . . . advantageously allows the LED circuits 7*a* . . . to easily have an equal control voltage and accordingly an equal luminance.

The control circuit part 10 comprises a column control circuit 10*v* and a row control circuit 10*h* controlling the columns and the rows of the display matrix circuit part 9, respectively. The column control circuit 10*v* has a function to turn on/off the first switching elements 3*a* of the display matrix circuit part 9, in other words a function to turn on the first switching elements 3*a* for a given time period (Ts) in sequence. Therefore, the gates of the FETs 3*aq* . . . are connected to the column control circuit 10*v*.

On the other hand, the row control circuit 10*h* has a function to simultaneously turn on/off a row La, Lb, Lc, . . . , or Le of six second switching elements 4 extending across the LED circuits 7*a*, 7*b*, 7*c*, . . . , and 7*f*, in other words a function to turn on/off a row La, Lb, Lc, . . . , or Le of six second switching elements 4 in correspondence with the first switching elements 3*a* being turned on. To do so, the row control circuit 10*h* has five third switching elements 5*a*, 5*b*, 5*c*, . . . , and 5*e* for simultaneously turning on/off a row La, Lb, Lc, . . . , or Le of six second switches 4 extending across the LED circuits 7*a*, 7*b*, 7*c*, . . . , and 7*f* as shown in FIG. 2. The third switching elements 5*a*, 5*b* . . . are connected to the constant current power source 8*p* (the cathode of the constant current diode 22) via current limiting resistors Ra, Rb, Rc, . . . , and Re, respectively. In this case, the third switching elements 5*a*, 5*b*, . . . , and 5*e* are n-type FETs 5*aq*, 5*bq* . . . . The number 24 presents a bidirectional zener diode connected between the gate and the sources of each FET 5*aq* . . . . Then, the gates of the FET 4*q* . . . are connected to the drains of the corresponding FET 5*aq*, 5*bq* . . . (see the circuit Xo in FIG. 2) and the gates of the FETs 5*aq*, 5*bq* . . . are connected to the row control circuit 10*h*.

The third switching elements 5*a* . . . and current limiting resistors Ra . . . are provided for the following reasons. The gate voltage for turning on the FETs 4*q* . . . (second switching elements 4 . . . ) has to be higher than the source voltage at least by 1 [V]. The source voltage of the FETs 4*q* . . . varies depending on the number of subsequent LEDs 2 . . . connected to be turned on and becomes higher as the number is increased. Then, the voltage for turning on the FET 4*q* . . . must be very high in some cases. In such a case, the output port that cannot supply a higher voltage than the power voltage of the microcomputer (processor 41) may not be useful for controlling. Therefore, the gate voltage of the FETs 4*q* . . . is supplied from the cathode of the constant current diode 22 via the FETs 5*aq*, 5*bq* . . . (third switching elements 5*a*, 5*b* . . . ) and the row control circuit 10*h* is used to turn on/off the FETs 5*aq*, 5*bq* . . . . In this way, when the third switching elements 5*a*, 5*b* . . . consist of the FETs 5*aq*, 5*bq* . . . , respectively, the gate voltage of the FETs 5*aq*, 5*bq* . . . can be approximately 1 [V] provided that the source voltage is at the ground level. In this way, the FETs 5*aq* . . . (third switch elements 5*a* . . . ) can be controlled with low voltage and constant voltage using the output port of the microcomputer (processor 41) and the FETs 4*q* . . . (second switching elements 4 . . . ) can also be controlled. The current limiting resistors Ra, Rb, . . . , and Re serve to prevent the supply current Ip from the constant current diode 22 from branching into the third switching elements 5*a* . . . . With the above structure, the second switching elements 4 . . . can be turned on/off in a stable manner regardless of the number of the LEDs 2 . . . in each LED circuit 7*a* . . . .

Furthermore, a fourth switching element 6 is connected between the constant current power source 8*p* and the ground. The column control circuit 10*v* (control circuit part 10) has a function to turn on the fourth switching element 6 for a given time period Tm . . . including the turn-off period To . . . of the first switching elements 3*a*, 3*b* . . . . The fourth switching element 6 is an n-type FET 6*q*, the gate of which is connected to the column control circuit 10*v*. The number 25 . . . presents a bidirectional zener diode connected between the gate and the source of the FET 6*q*. The fourth switching element 6 serves as a dummy circuit for the LED circuits 7*a* . . . to achieve a magnitude-stabilized (continuous) supply current Ip, thereby reducing the switching noise that occurs when the first switching elements 3*a* . . . are turned on/off.

Operation of the LED display apparatus 1 according to this embodiment is described hereafter with reference to FIGS. 1, 2, and 7 to 9.

Figure 7:
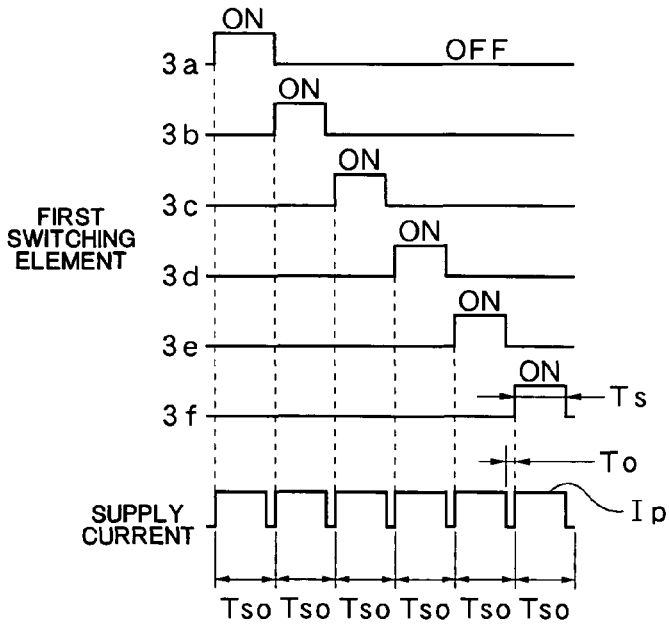
FIG. 7 is an operation timing chart of the LED display apparatus.
Figure 8:
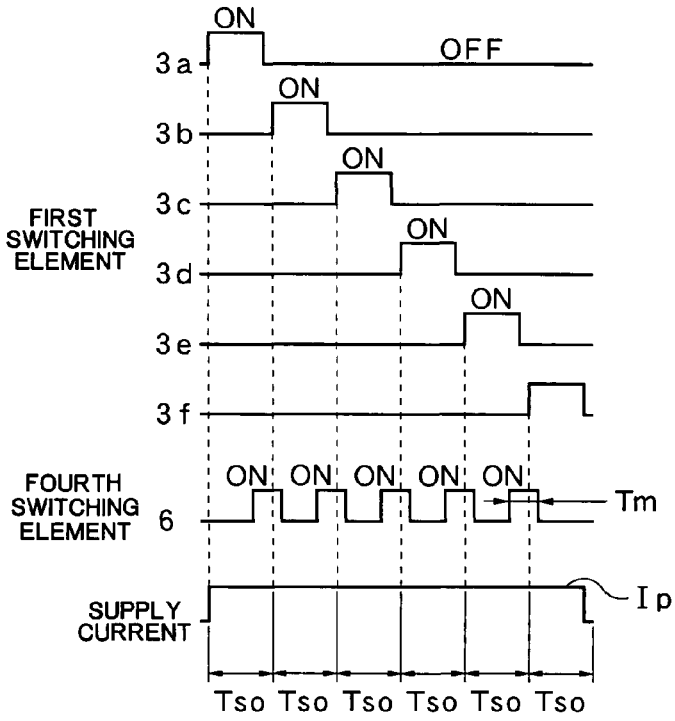
FIG. 8 is another operation timing chart of the LED display apparatus.

First, as shown in FIG. 7, the column control circuit 10*v* turns on the first switching elements 3*a* . . . for a given time period (Ts) in sequence. In other words, it performs dynamic drive control. The scan cycle Tso (scan speed) is set for around 1 [ms] at which no shimmering is observed. Meanwhile, a turn-off period To occurs after one first switching element 3*a* . . . is tuned off and before the next first switching element 3*b* . . . is turned on. Consequently, an intermittent supply current Ip flows through the constant current diode 22 in accordance with the turn-on/turn-off of the first switching elements 3*a* . . . , causing the switching noise. However, with the provision of the fourth switching element 6, the supply current Ip flows while the fourth switching element 6 is turned on for a given time period Tm . . . including the turn-off period To . . . of the first switching elements 3*a*, 3*b* . . . as shown in FIG. 8, achieving a magnitude-stabilized (continuous) supply current Ip, thereby reducing the switching noise that occurs when the first switching elements 3*a* . . . are turned on/off.

On the other hand, in this state, the row control circuit 10*h* simultaneously turns on/off a row La, Lb, Lc . . . of multiple second switch elements 4 . . . extending across the LED circuits 7*a*, 7*b*, 7*c*, . . . , and 7*f* in correspondence with the figure Na, Nb . . . to be displayed; in other words, it turns on/off the third switching elements 5*a*, 5*b* . . . in correspondence with the turn-on period of the first switching elements 3*a*, 3*b* . . . . Here, the second switching elements 4 . . . and third switching elements 5*a* . . . are FETs. Therefore, when the third switching elements 5*a* . . . are turned on, the second switching elements 4 . . . are turned off, whereby the LEDs 2 . . . are turned on. When the third switching elements 5*a* . . . are turned off, the second switching elements 4 . . . are turned on, whereby the LEDs 2 . . . are turned off. In this way, the LEDs 2 . . . of which the first switching element 3*a* . . . is turned on and the third switching element 5*a* . . . is turned on is turned on. When the LEDs 2 . . . are turned on, the supply current Ip flows from the hot line 21 to the LED circuits 7*a* . . . via the constant current diode 22 and integration circuit 12.

The integration circuit 12 functions as follows. In the LED circuits 7*a*, 7*b* . . . , the gate voltage of the FETs 4*q* . . . (second switching elements 4 . . . ) is supplied from the cathode of the constant current diode 22. When the LED circuits 7*a*, 7*b* . . . are switched by the FETs 3*aq* . . . (first switching elements 3*a* . . . ), the supply current IP may flow to the LEDs 2 . . . before it is determined whether or not the FETs 4*q* . . . are tuned on/off. This results in unstable turn-on/turn-off control of the LEDs 2 . . . . Therefore, the integration circuit 12 forces the supply current Ip to delay so that it is determined whether or not the FETs 4*q* . . . are turned on/off before the supply current Ip flows to the LEDs 2 . . . . In this way, inconvenient unstable turn-on/turn-off control of the FETs 4*q* . . . is eliminated and the LEDs 2 . . . are turned on in a stable manner. The resistors Rp serve to prevent the gate voltage of the FETs 4*q* . . . from becoming lower than the source voltage. In other words, the resistors Rp serve to forcefully establish a potential difference between the gate and the source of the FETs 4*q* . . . to reliably turn on the FETs 4*q* . . . (second switching element 4 . . . ).

When the cathode of the constant current diode 22 has no load while the FETs 3*aq* . . . (first switching elements 3*a* . . . ) are turned on/off, the cathode voltage of the constant current diode 22 is increased to the voltage of the hot line 21 and an excessive voltage may be applied between the gate and the source of the FETs 4*q* . . . (second switching elements 4 . . . ). The zener diodes Dz (constant voltage circuit 11) in the power circuits 8 protect the FETs 4*q* . . . against this excessive voltage.

Figure 9:
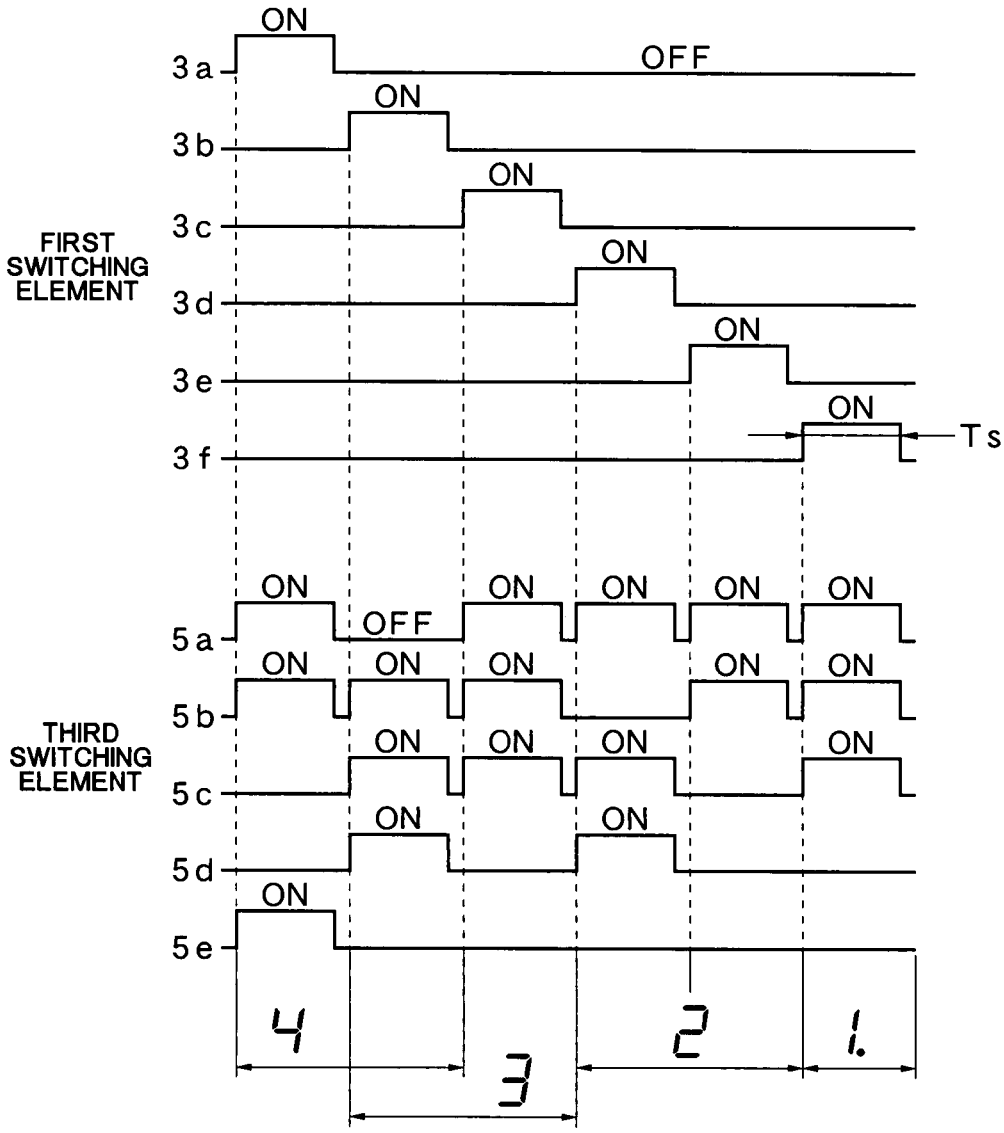
FIG. 9 is a further other operation timing chart of the LED display apparatus.

FIG. 9 shows an embodiment of the above control to display "1.234." In this case, when the first switching element 3*a* is turned on, three third switching elements 5*a*, 5*b*, and 5*e* are turned on. When the first switching element 3*b* is turned on, three third switching elements 5*b*, 5*c*, and 5*d* are turned on. When the first switching element 3*c* is turned on, three third switching elements 5*a*, 5*b*, and 5*c* are turned on. When the first switching element 3*d* is turned on, three third switching elements 5*a*, 5*c*, and 5*d* are turned on. When the first switching element 3*e* is turned on, two third switching elements 5*a* and 5*b* are turned on. When the first switching element 3*f* is turned on, three third switching elements 5*a*, 5*b*, and 5*c* are turned on.

Consequently, when the first switching element 3*a* is turned on and when the first switching element 3*b* is turned on, a figure "4" is displayed as the least significant digit (the figure Na). When the first switching element 3*b* is turned on and when the first switching element 3*c* is turned on, a figure "3" is displayed as the next higher digit (the figure Nb). When the first switching element 3*d* is turned on and when the first switching element 3*e* is turned on, a figure "2" is displayed as the next higher digit (the figure Nc). When the first switching element 3*f* is turned on, a figure "1" is displayed as the next higher digit (the figure Nd) and a dot "." is displayed by a dot da. Then, the LED display panel 35*p* displays "1.234."

In the LED display apparatus 1 according to this embodiment, a low drive voltage can be used even if the number of LEDs 2 . . . to be used is increased, leading to down-sizing of the power circuit part 8 and reduced cost and eliminating inconvenient limitation on the number of LEDs 2 . . . to be used or reduced luminance. Furthermore, uniform luminance and reduced power consumption are achieved, resolving the prior art contradictory problems in particular. Even when the display matrix circuit part 9 is used, the LEDs 2 . . . are individually controlled, eliminating inconvenient limitation on display applications and allowing for higher universality and versatile displays. Furthermore, the LEDs 2 . . . constitute the segments naa, nab, nac, . . . , nba, nbb, nbc . . . of at least one or more figures Na, Nb . . . , which is suitable for the distal display system using such figures Na, Nb . . . .

The best embodiment is described in detail above. The present invention is not restricted to this embodiment and any modifications in detailed structure, shape, material, quantity, and numerical value can be made without departing from the scope of the present invention and so can any additions or omissions where necessary. For example, the LED display apparatus 1 is applied to a pressure gauge M. The pressure gauge M is not necessarily the described one. The LED display apparatus 1 can be used as an LED display apparatuses for similar displays in other various types of pressure gauges and various applications other than pressure gauges. In such cases, the display can include not only figures but also various displays such as characters and images.

What is claimed is:

1. An LED display apparatus, comprising:

a power circuit having a constant current power source;

a display matrix circuit connected to said power circuit, said display matrix circuit including multiple LED circuits parallel-connected to each other, each of said parallel-connected LED circuits including:

multiple LEDs connected in series, a single first switching element serially-connected to the multiple LEDs connected in series, and multiple second switching elements connected in series to each other, each second switching element connected in parallel to a corresponding one of the multiple LEDs connected in series so as to form rows of multiple second switching elements extending across said display matrix circuit, each row including one second switching element of each of said multiple LED circuits connected in parallel; and a control circuit including a column control circuit connected to each of said parallel-connected LED circuits and configured to turn on the first switching element of each of said parallel-connected LED circuits for a given time period in a predetermined sequence, and a row control circuit connected to each of said rows and configured to turn on/off one or more of the rows in correspondence with the column control circuit turning on the first switching element of each of said parallel-connected LED circuits.

2. The LED display apparatus according to claim 1, wherein the control circuit is configured to cause the display matrix circuit to display one or more alphanumeric symbols.

3. The LED display apparatus according to claim 1, wherein the first switching element of each of said parallel-connected LED circuits are FETs.

4. The LED display apparatus according to claim 1, wherein the multiple second switching elements connected in series to each other are FETs.

5. The LED display apparatus according to claim 1, wherein each of the multiple second switching elements connected in series to each other include a zener diode.

6. The LED display apparatus according to claim 1, wherein said power circuit has an integration circuit constituted by a resistor connected between said constant current power source and said display matrix circuit and a capacitor connected between the current-output end of said resistor and the ground.

7. The LED display apparatus according to claim 1, wherein the row control circuit includes multiple third switching elements connected to said constant current power source via respective current limiting resistors, each third switching element connected to a corresponding one of the rows of multiple second switching elements extending across said display matrix circuit.

8. The LED display apparatus according to claim 7, wherein said third switching elements are FETs.

9. The LED display apparatus according to claim 1, further comprising:

a fourth switching element that is connected between said constant current power source and ground, wherein said column control circuit is further configured to turn on said fourth switching element for a predetermined time period corresponding to a turn-off period of the first switching element of each of said parallel-connected LED circuits.

10. The LED display apparatus according to claim 9, wherein said fourth switching element is an FET.

11. The LED display apparatus according to claim 1, further comprising:

a connection between the control circuit and a pressure gauge.

12. The LED display apparatus according to claim 11, wherein said connection includes a serial circuit of a direct current power source and a receiver in a two-line transfer system via a connection cable.

* * * * *